US008863789B2

(12) United States Patent
Clüsserath et al.

(10) Patent No.: US 8,863,789 B2
(45) Date of Patent: Oct. 21, 2014

(54) METHOD AND FILLING SYSTEM FOR FILLING CONTAINERS IN A PRESSURIZED MANNER

(75) Inventors: Ludwig Clüsserath, Bad Kreuznach (DE); Dieter-Rudolf Krulitsch, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 13/510,042

(22) PCT Filed: Nov. 18, 2010

(86) PCT No.: PCT/EP2010/007006

§ 371 (c)(1),
(2), (4) Date: May 16, 2012

(87) PCT Pub. No.: WO2011/095187

PCT Pub. Date: Aug. 11, 2011

(65) Prior Publication Data

US 2012/0216906 A1 Aug. 30, 2012

(30) Foreign Application Priority Data

Feb. 8, 2010 (DE) ..... 10 2010 007 288

(51) Int. Cl.
*B65B 3/00* (2006.01)
*B67C 3/24* (2006.01)

(52) U.S. Cl.
CPC ..... *B67C 3/242* (2013.01)
USPC ..... 141/52; 141/275; 141/279; 141/284

(58) Field of Classification Search
CPC ..... B67C 3/242
USPC ..... 141/46, 47, 52, 266, 275, 277, 278, 141/279, 281, 284, 383
See application file for complete search history.

(56) References Cited

U.S. PATENT DOCUMENTS

| | | | | |
|---|---|---|---|---|
| 5,295,517 | A * | 3/1994 | Ahlers | 141/1 |
| 7,311,125 | B2 * | 12/2007 | Krulitsch | 141/149 |
| 8,151,833 | B2 * | 4/2012 | Thomas et al. | 141/95 |
| 2011/0030843 | A1 * | 2/2011 | Krulitsch | 141/311 R |

FOREIGN PATENT DOCUMENTS

| | | |
|---|---|---|
| DE | 2126113 | 11/1972 |
| DE | 3713015 | 10/1988 |
| DE | 3830663 | 3/1990 |

(Continued)

*Primary Examiner* — Timothy L Maust
(74) *Attorney, Agent, or Firm* — Occhiuti & Rohlicek LLP

(57) ABSTRACT

The invention relates to a filling system for filling bottles, cans, or similar containers (2) with a liquid filling good, comprising at least one filling element (1, 1*a*) having at least one dispensing opening (7) for introducing the filling good into the particular container (2) in a controlled manner, means (10) for retaining and pressing the particular container (2) having a container opening (2.1) in a sealing position against the filling element (1, 1*a*) in the area of the dispensing opening (7), at least one pneumatic device (15.1, 16.1, 19) for producing at least one component of the press-on force, which pneumatic device can be exposed to the pressure (P1) of a gaseous and/or vaporous operating medium. In order to change and/or set the press-on force, a second component of said force is produced by a further hydraulic or pneumatic device (15.2, 16.2, 20), which is exposed to a variable or settable pressure (P2, P3, P5) of a liquid and/or gaseous and/or vaporous auxiliary medium preferably different from the process medium or is exposed to a vacuum (VAK).

11 Claims, 5 Drawing Sheets

(56) References Cited

FOREIGN PATENT DOCUMENTS

| | | |
|---|---|---|
| DE | 19545080 | 6/1997 |
| DE | 19545080 A1 * | 6/1997 |
| DE | 102008011109 | 9/2009 |
| EP | 0318463 | 5/1989 |
| EP | 0989088 | 3/2000 |
| EP | 1520833 | 4/2006 |
| GB | 2204306 | 11/1988 |

* cited by examiner

METHOD AND FILLING SYSTEM FOR FILLING CONTAINERS IN A PRESSURIZED MANNER

CROSS REFERENCE TO RELATED APPLICATIONS

This application is the national stage entry, under 35 USC 371, of PCT/EP2010/007006, filed Nov. 18, 2010, which, under 35 USC 119, claims the benefit of the priority date of German application no. 10 2010 007 288.5, filed Feb. 8, 2010. The contents of both applications are incorporated herein in their entirety.

FIELD OF DISCLOSURE

The invention relates to container filling, and in particular, to controlled introduction of liquid goods into a container.

BACKGROUND

Methods and filling systems for filling containers and in particular for the pressurized filling of containers (filling of containers under stressing or filling pressure) with a liquid filling good, for example with a carbonated filling good or drink, are known in different embodiments, including in the form of rotary filling machines in particular. Here, at least during one phase of a filling process, in particular during the actual filling phase in which the filling of the container pre-stressed with the stressing pressure or filling pressure takes place, and/or during a stress phase and/or pre-stress phase preceding the filling phase, the respective container is pressed by a press-on force with a mouth edge surrounding its container opening tightly or in sealing position up against the filling element in the region of a dispensing opening located there for the liquid filling good.

It is also known in particular (EP 1 520 833 B1) that the press-on force can be produced by a pneumatic device, e.g. in the form of a pneumatic piston/cylinder arrangement, which is part of a lifting device for a container carrier carrying or holding the respective container during the filling process and pressing it against the filling element and which is subjected to the pressure (clamping or filling pressure) of a gaseous and/or vaporous process medium that is used during the filling process and being in the form of an inert gas used as a purging and/or stressing and/or pre-stressing gas. The filling system and/or the corresponding filling machine exhibit a plurality of filling elements each having a container carrier and associated lifting device.

One basic advantage of such a filling system lies in a simplified control of the lifting devices for the container carriers and also in particular in a reduction of the number of, and/or the load on, control elements on the filling element side, for example cam rollers that, in interaction with at least one static control cam, ensure the condition of the container carriers when lowered from the filling element at the container entry as well as at the container exit of the filling machine for transferring the empty containers to the filling elements or to the container carriers located there, and for removing the filled containers from the container carriers.

A disadvantage of such filling systems, however, is that the pressure of the purging and/or stressing and/or pre-stressing gas is predetermined by process parameters, in particular by parameters specific to the filling good, such as its nature, its $CO_2$ content, and its temperature, and also by machine-related parameters, such as the throughput of the filling machine (filled containers per unit of time etc.). This pressure cannot easily be altered or can at best only be altered within certain limits.

If containers with different mouth diameters, for example bottles with mouth diameters of 28, 30 or 38 mm, are now to be filled on one and the same filling machine, then the pneumatic device that produces the press-on force must be designed to supply the clamping or press-on force that is sufficient for the containers with the biggest mouth diameter while taking into account the filling or stressing pressure. This also means, however, that this press-on force far exceeds the level required for containers with a smaller mouth diameter. This results in excessive press-on force exerting an unnecessarily high mechanical load on containers with a smaller mouth diameter. This can destroy or at least damage the containers, especially thin-walled containers and/or containers made from plastic.

SUMMARY

The task of the invention is to propose a method that allows a setting or alteration or adjustment of the respective press-on force while retaining the fundamental advantages offered by producing the press-on force from the pressure of the gaseous and/or vaporous process medium.

A gaseous and/or vaporous auxiliary medium with which the further component of the respective press-on force is produced and whose pressure acting at least in the further pneumatic device is settable and/or variable, is for example air, preferably sterile air.

The auxiliary medium can, of course, also be a liquid, for example, water, preferably sterile water, or in certain applications even the filling good itself. For the purpose of the present invention therefore the term "auxiliary medium" is to be understood expressly as a fluid auxiliary medium. Express reference to the possibly of liquid auxiliary medium will be dispensed with hereinbelow merely to simplify readability and without in any way limiting the scope of protection.

The gaseous and/or vaporous process medium is the medium with which the containers are treated and/or pressurized during the filling process, for example the purging, stressing and/or pre-stressing gas in the form of inert gas, e.g. in the form of $CO_2$ gas or a gaseous or vaporous medium for sterilizing the containers prior to filling. The process medium, in the sense of the invention, is, however, also a cleaning and/or sterilization medium used for cleaning and/or sterilization of the filling system, preferentially for a CIP cleaning and/or sterilization of the filling system.

The inventive method or inventive filling system is preferably configured so that the first component, which is produced by the pressure of the process medium, of the press-on force is greater than the component produced by the pressure of the auxiliary medium.

If the filling system is part of a rotary filling machine having a plurality of filling elements with attendant container carriers, then the control is effected, for example, such that the further pneumatic devices of all filling elements are constantly subjected to that pressure of the auxiliary medium that provides the desired or necessary clamping force, and that the container carriers at the container entry and at the container exit are moved by control cams into a lower lifting position against the action of the further pneumatic devices.

The setting and/or regulating of the pressure of both the process medium and auxiliary medium is preferentially effected by electro-pneumatic regulators, for example as a function of data or programs stored in an electronic control system (e.g. process controller) of the filling system or filling machine, or as a function of product-related and machine-related parameters.

Further embodiments, advantages, and possible applications of the invention arise out of the following description of embodiments and out of the figures. All of the described and/or pictorially represented attributes, whether alone or in any desired combination, are fundamentally the subject matter of the invention independently of their synopsis in the claims or a retroactive application thereof. The content of the claims is also made an integral part of the description.

DESCRIPTION OF THE DRAWINGS

The invention is explained in detail below through the use of embodiment examples with reference to the figures. In the figures.

DETAILED DESCRIPTION

Figure 1:
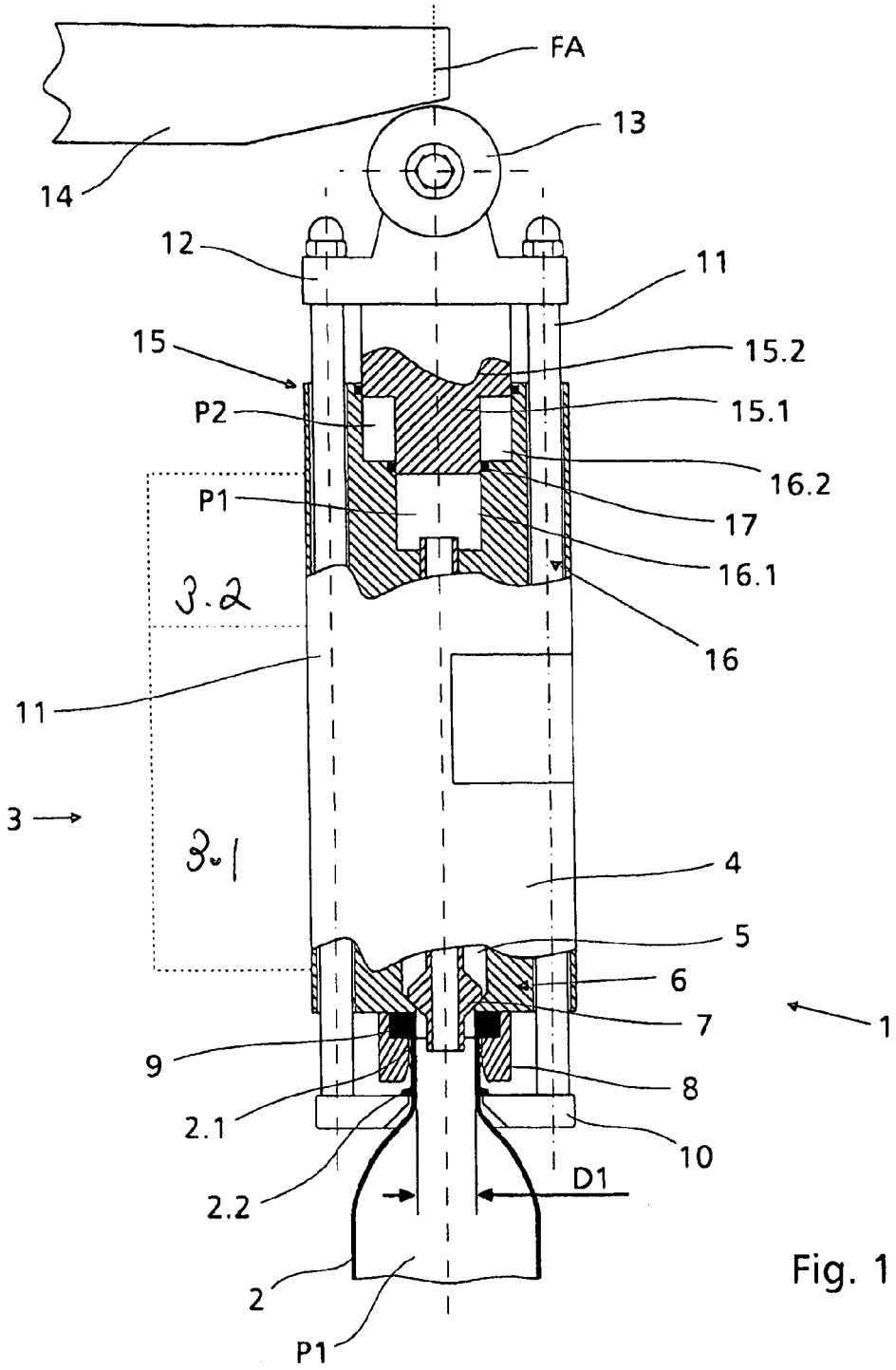
FIGS. 1-4 each show different operating states of a filling element of a filling system or of a filling machine for the pressurized filling of containers.

The filling element generally identified by "1" in FIGS. 1-4 is part of a filling system or rotary filling machine for filling containers, for example bottles 2, under pressure with a liquid filling good, e.g. with a carbonated filling good or drink. Filling element 1 is arranged with a plurality of identical filling elements on the periphery of a rotor that can be driven to rotate about the vertical machine axis and of which a filling good tank or ring tank 3 is only very schematically shown in FIG. 1. During the filling operation, the latter is partly filled with the liquid filling good that is to be introduced into bottles 2 via filling elements 1, so that a lower liquid space 3.1 occupied by the filling good and an upper gas space 3.2 are formed in the interior of ring tank 3. This gas space is occupied by a gaseous or vaporous process medium, e.g. inert gas or $CO_2$ gas, to which a pressure P1 (clamping or filling pressure) is applied. Inside a housing 4 of filling element 1, there is configured, inter alia, a liquid channel 5 in which, inter alia, a liquid valve 6 is disposed for the controlled dispensing of the liquid filling good into respective bottle 2 and that, in the direction of flow of the filling good, is connected upstream of liquid valve 6 to a liquid space 3.1 of the ring tank 3 and, in the direction of flow of the liquid filling good, opens out downstream of liquid valve 6 into a dispensing opening 7 on the underside of filling element 1 or of filling element housing 4. Dispensing opening 7 is enclosed by a ring seal 9, which is disposed in a centering tulip 8 and concentrically encloses filling element axis FA, and against which, during filling, the respective bottle 2 arranged with its bottle axis on the same axis as axis FA lies pressed with a mouth edge 2.1 surrounding the bottle opening.

Pressure P1 is set and regulated as a function of the nature and/or temperature of the filling good, for example as a function of the $CO_2$ content of the filling good, for example by an electropneumatic regulator as a function of data or programs stored in an electronic control device (process controller) of the filling machine.

Each filling element 1 is, moreover, associated with a container carrier 10 that, in the depicted embodiment, is designed to hold bottles 2 suspended, i.e. to hold bottles 2 by a mouth flange 2.2. Container carrier 10 is attached at the lower end of two guide rods 11 that it interconnects and that, in their longitudinal extension, are arranged parallel with one another and with axis FA on either side of that axis, and can be displaced axially in filling element housing 4. At their upper end, protruding above the filling element housing 4, the guide rods 11 are interconnected by a bearing piece 12 on which a cam roller 13 is mounted free to rotate about an axis radial to the axis of the rotational movement of the rotor or of the ring tank 3 so as to interact with a control cam 14 that is static, i.e. that does not rotate with the rotor or with ring tank 3. On the underside, facing away from the cam roller 13, there acts on bearing piece 12 a piston 15 that is configured as a stepped piston having two piston sections 15.1 and 15.2. Of the latter, piston section 15.1, with the lesser diameter, is provided in a cylinder space 16.1 and piston section 15.2, with the greater diameter, is provided in an annular cylinder space 16.2 that surrounds piston section 15.1, both piston sections being displaceable axially, i.e. in the direction of axis FA. Cylinder space 16.2 is stepped in design, having a greater diameter in its upper region and having a reduced diameter in its lower region, such that within cylinder space 16.2 there is formed a stop or collar 17 against which piston section 15.2 is in contact when piston 15 is fully lowered in the direction of the filling element underside.

At least during the pressurized filling of respective bottle 2, cylinder space 16.1 is pressurized with pressure P1 from gas space 3.2 of ring tank 3 so that piston 15 moves upward and/or is pre-stressed by pressure P1 present in cylinder space 16.1 and as a result respective bottle 2 is pressed with its bottle mouth 2.1 against ring seal 9 by piston 15, bearing element 12, the two guide rods 11 and container carrier 10. Into cylinder space 16.1 also emerges the upper end of a gas pipe 6.1 arranged on the same axis as axis FA and also serving as a valve stem for the valve body of liquid valve 6, the lower open end of the gas pipe reaching the interior of bottle 2 in sealed position with the filling element so that the latter is also pre-stressed with inert gas pressure P1 at least during filling.

Pressure P1 is predetermined by various filling and/or system parameters, for example by the temperature and/or the nature and/or the inert gas or $CO_2$ gas content of the liquid filling good, so that the press-on force produced by the piston/cylinder arrangement consisting of piston section 15.1 and cylinder space 16.1 is not freely variable and is, in particular, not variable for adjusting the press-on force to containers or bottles with different diameters in the region of the container or bottle mouth 2.1.

Piston section 15.2 and cylinder space 16.2 together form a piston/cylinder arrangement that, despite the constant or generally constant pressure P1, permits a variation or setting of the press-on force with which the respective bottle 2 lies pressed with its mouth edge 2.1 against seal 9. For this purpose, cylinder space 16.2 can be pressurized with a liquid, and/or gaseous, and/or vaporous auxiliary medium, for example air, preferentially sterile air, with a variable pressure P2, so that the press-on force is generally a function of pressures P1 and P2 and by changing pressure P2 is variable and/or adaptable to particular requirements, in particular also to the respective mouth diameter D1 of the container or of bottle 2 in the region of bottle mouth 2.1.

Simplified control and improved operational reliability for filling elements 1 are obtained, inter alia, by the production from inert gas pressure P1 of the press-on force with which respective bottle 2 lies pressed against ring seal 9, at least during pressurized filling. An advantage of generating the preferentially greater component of the press-on force from pressure P1 of the process medium (purging gas and/or stressing gas and/or pre-stressing gas), e.g. inert or $CO_2$ gas, is also that the respective cylinder space 16.1 is depressurized in the region both of the container or bottle entry and container and bottle exit, thereby reducing the load on cam rollers 13 interacting with control cam 14 with lowered container carriers 10 within the angular range of the rotary motion of the rotor between container exit and container entry.

FIG. 1 shows filling element 1 together with a bottle 2 that is in sealed position against it and that has a lesser mouth diameter D1, e.g. a bottle having a mouth diameter D1 of 28 mm. Only the press-on force produced by pressure P1 (stressing or filling pressure) via piston section 15.1 is used for pressing-on these bottles 2, for example, at most with minimal support from the press-on force produced by piston section 15.2.

Figure 2:
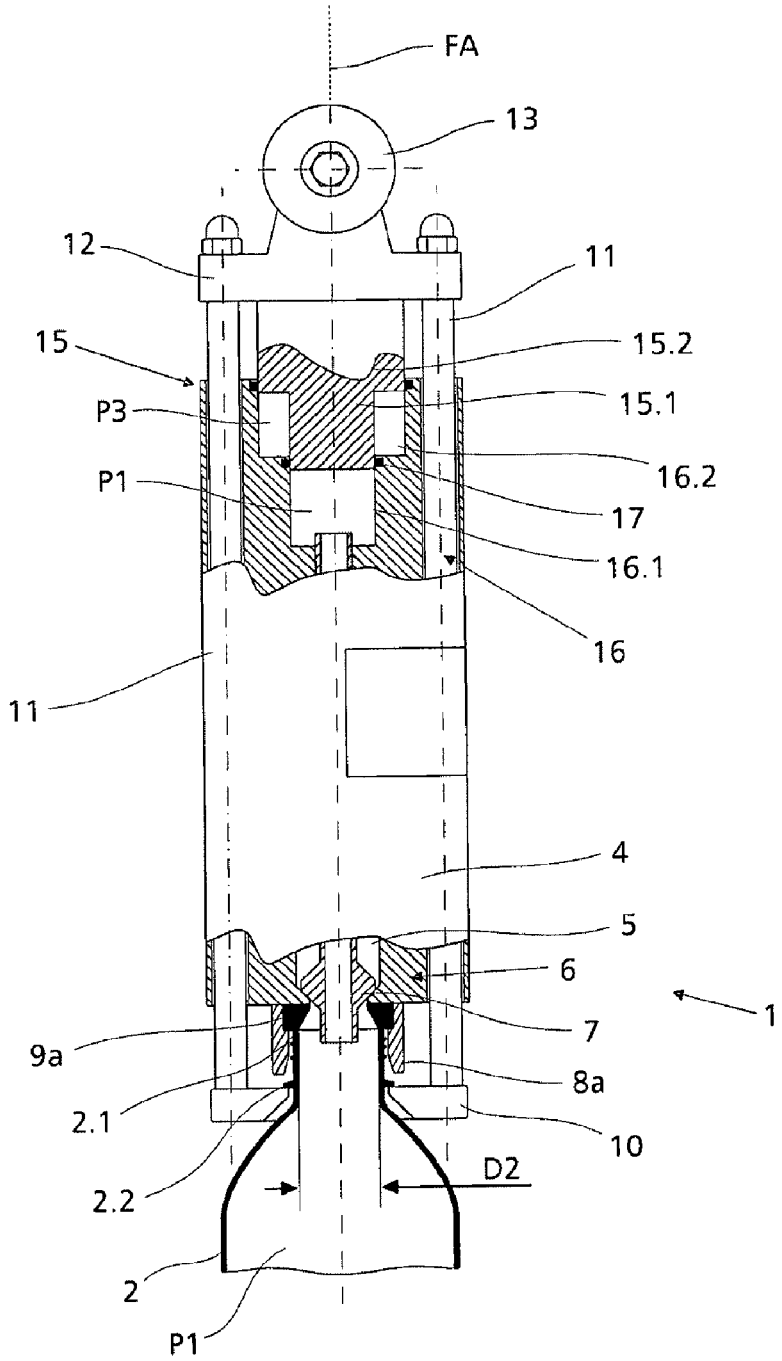

FIG. 2 shows filling element 1 for filling bottles 2 that have a considerably greater mouth diameter D2 at their mouth edge. For filling these bottles 2, centering tulips 8 with seal 9 are preferentially exchanged for centering tulip 8*a* with ring seals 9*a* that (centering tulips) exhibit a somewhat larger inside cross-section. The press-on force that is produced by piston section 15.1 and that is additionally produced by piston section 15.2 is used to press bottles 2 against respective filling element 1 during pressurized filling, with cylinder space 16.2 being pressurized by pressure P3 of the vaporous or gaseous auxiliary medium. Pressure P3 of the auxiliary medium may be greater or less than pressure P2. In any event, pressure P3 is set so that its force effect is sufficient to produce the necessary additional press-on force.

Figure 3:
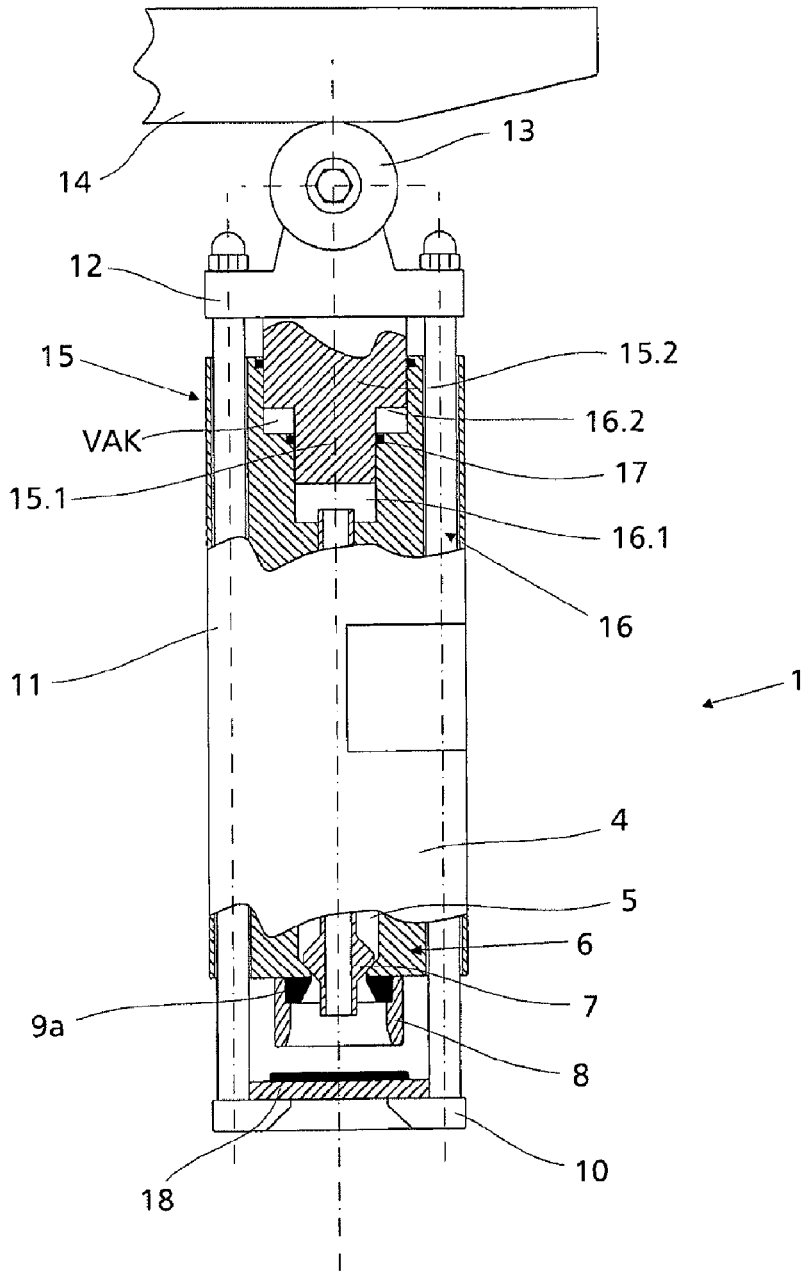

FIG. 3 shows filling element 1 in a position preparing a CIP cleaning and/or disinfection of the filling system, in which (position) sealing or purging plates 18 are seated onto the lowered container carriers 10 of the filling elements. Interaction of control cam 14 with respective control roller 13 ensures that when sealing or purging plate 18 is seated, container carrier 10 of each filling element 1 is in the lowest position in which piston section 15.2 is in contact against collar 17, which acts as a stop.

In order to receive, at a bottle entry of the filling machine, the respective empty bottle 2 that is to be filled and to remove the respective filled bottle at a bottle exit of the filling machine, respective container carrier 10 with bottle is lowered, for example, into a position where piston 15 is lying with its piston section 15.2 against collar 17. The lowered state is attained or ensured by the interaction of respective cam roller 13 with control cam 14. Alternatively however the lowered state of respective container carrier 10 can also be attained or at least ensured by applying a vacuum VAK to cylinder space 16.2. This approach places piston 15, as shown in FIG. 3, in the lowest possible position.

Figure 4:
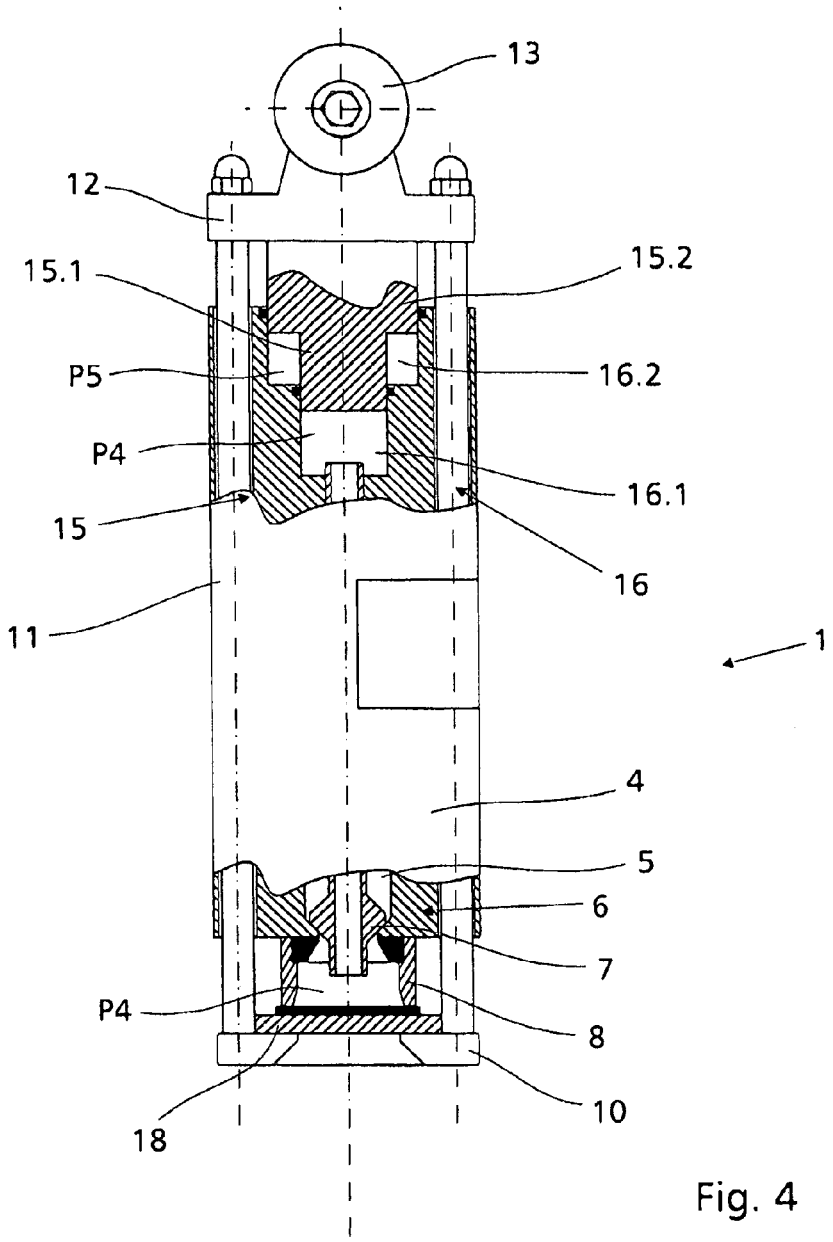

FIG. 4 shows filling element 1 in a state in which, with the help of the raised container carrier 10, the sealing or purging plate 18 lies sealed with its seal provided on the top of the plate up against the edge of centering tulip 8*a*, thereby forming a purging space that is inside centering tulip 8*a* and sealed to the environment. The necessary press-on force is achieved through pressure P4, present in cylinder space 16.1, of the medium used for the CIP cleaning and/or disinfection and in particular by pressurizing cylinder space 16.2 with auxiliary medium at pressure P5.

Figure 5:
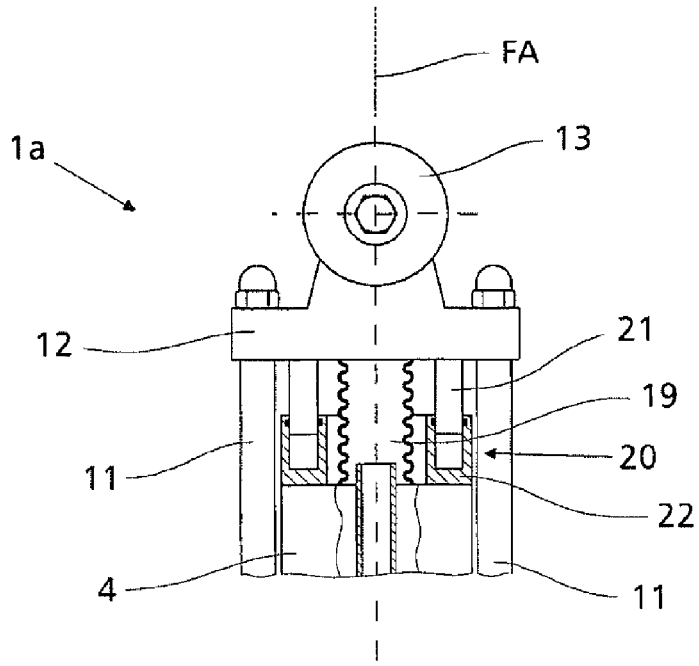
FIG. 5 shows a simplified partial view of further embodiment of a filling element.

FIG. 5 shows a schematic partial view of a filling element 1*a* that differs from filling element 1 in that, to produce the component of the press-on force that results from pressure P1, there is provided a bellows 19 that, during the pressurized filling, is pressurized with pressure P1 and that acts between the top of filling element housing 4 and the bottom of bearing piece 12. As well as bellows 19, there is provided a piston/cylinder arrangement 20 for producing the component of the press-on force resulting from the auxiliary medium pressure. In the depicted embodiment, piston/cylinder arrangement 20 consists of an annular piston 21 that concentrically encloses axis FA and the axis of bellows 19 and with which is associated an annular cylinder space 22. The latter can be pressurized with the pressure of the auxiliary medium, for example with pressure P2, P3, P5, or with vacuum VAK. Instead of annular piston 21 and annular cylinder space 22 in which annular piston 21 is displaceable axially i.e. along axis FA, the piston/cylinder arrangement provided additionally to bellows 19 and also acting between the top of filling element housing 4 and bearing piece 12 can also be otherwise configured, for example comprising two circular cylinder spaces radially offset relative to bellows 19, with an associated piston.

The invention has been described above by reference to embodiments. It goes without saying that numerous variations as well as modifications are possible without departing from the inventive concept underlying the invention.

LIST OF REFERENCE SIGNS

1, 1*a* Filling element
2 Bottle
2.1 Mouth edge
2.2 Mouth flange
3 Ring tank
3.1 Liquid or filling good space
3.2 Gas space
4 Filling element housing
5 Liquid channel
6 Liquid valve
6.1 Valve stem or gas pipe
7 Dispensing opening
8 Centering tulip
8*a* Centering tulip
9 Ring seal
9*a* Ring seal
10 Container carrier
11 Guide rod
12 Bearing piece
13 Cam roller
14 Control cam
15 Stepped piston
15.1 Piston section
15.2 Piston section
16 Stepped cylinder
16.1 Cylinder space
16.2 Cylinder space
17 Collar
18 Sealing or purging plate
19 Bellows
20 Piston/cylinder arrangement
21 Annular piston
22 Cylinder space
FA Filling element axis
D1 Mouth diameter
D2 Mouth diameter

The invention claimed is:

1. An apparatus for filling containers with a liquid filling good, said apparatus comprising a filling element, said filling element comprising a dispensing opening, a centering tulip, a ring seal, a bellows, and a pneumatic device, wherein said dispensing opening provides controlled introduction of said filling good into a particular container having a container opening, wherein said ring seal encloses said dispensing opening, wherein said ring seal is disposed on said centering tulip against which, during operation, said container is pressed, wherein said bellows defines an interior space that is filled with a first pressure medium that has a first pressure, wherein said pneumatic device is exposed to a second pressure medium that has a second pressure, wherein said first pressure medium exerts a first force on said bellows as a result of said first pressure, wherein said second pressure medium exerts a second force on said pneumatic device as a result of said second pressure, wherein either said first pressure medium is an operating medium and said second pressure medium is an auxiliary medium, or said first pressure medium is an auxiliary medium and said second pressure medium is an operating medium, wherein said bellows and said pneumatic device cooperate to apply a press-on force to urge said tulip to press against said container, wherein said press-on force is a sum of a first force component and a second force component, wherein said first component of said press-on force is contributed by said bellows, wherein said second component of said press-on force is contributed by said pneumatic device, wherein at most one of said first component and said second component of said press-on force is fixed by properties of said liquid filling good, wherein a pressure of said auxiliary medium in said pneumatic device can be set for controlling said press-on force, wherein a pressure of said operating medium is not freely variable for controlling said press-on force, wherein controlling said press-on force is selected from a group consisting of varying said press-on force and setting said press-on force, wherein said operating medium is selected from a group consisting of a gaseous operating medium and vaporous operating medium, and wherein said auxiliary medium is selected from a group consisting of a gaseous auxiliary medium and a vaporous auxiliary medium, whereby said press-on force is adjustable by adjusting a force exerted by said auxiliary medium.

2. The apparatus of claim 1, wherein said operating medium comprises a process medium selected from a group consisting of a process medium used for treating said containers, a process medium used for treating said filling system, a purging gas, a stressing gas, a pre-stressing gas, an inert gas, carbon dioxide gas, a process medium used as a sterilization medium, a process medium used when filling containers, a gaseous sterilization medium used for cleaning said filling system, a gaseous sterilization medium used for sterilizing said filling system, a vaporous sterilization medium used for cleaning said filling system, and a vaporous sterilization medium used for sterilizing said filling system.

3. The apparatus of claim 1, wherein said filling element is associated with a container carrier on which said respective container is held at least during said filling process, and wherein said bellows and said pneumatic device are part of a lifting device that is configured to at least one of produce relative motion between said filling element and said container carrier and to press a container against said filling element, and to produce a lifting motion of said container carrier relative to said filling element.

4. The apparatus of claim 1, wherein said pneumatic device comprises a piston/cylinder arrangement, wherein said piston/cylinder arrangement comprises a cylinder space, wherein said cylinder space is configured to be pressurized by said pressure medium.

5. The apparatus of claim 1, wherein said pneumatic device comprises a piston/cylinder arrangement, wherein said piston/cylinder arrangement comprises a cylinder space, wherein said cylinder space is configured to be pressurized by said operating medium.

6. The apparatus of claim 1, further comprising a common piston/cylinder arrangement, wherein said common piston/cylinder arrangement is common to said bellows and said pneumatic device, wherein said common piston/cylinder arrangement comprises a stepped piston, a stepped cylinder, an inner piston section, an outer piston section, an inner cylinder space, and an outer annular cylinder space, wherein said inner cylinder space is delimited by said inner piston section, and wherein said outer annular cylinder space is delimited by said outer piston section, wherein said inner cylinder space is configured to be pressurized by said operating medium, and wherein said outer cylinder space is configured to be pressurized by said auxiliary medium.

7. The apparatus of claim 1, further comprising a common piston/cylinder arrangement, wherein said common piston/cylinder arrangement is common to said bellows and said pneumatic device, wherein said common piston/cylinder arrangement comprises a stepped piston, a stepped cylinder, an inner piston section, an outer piston section, an inner cylinder space, and an outer annular cylinder space, wherein said inner cylinder space is delimited by said inner piston section, and wherein said outer annular cylinder space is delimited by said outer piston section, wherein said inner cylinder space is configured to be pressurized by said auxiliary medium, and wherein said outer cylinder space is configured to be pressurized by said operating medium.

8. The apparatus of claim 1, wherein said pneumatic device is formed by a piston/cylinder arrangement, wherein said piston/cylinder arrangement comprises an annular cylinder space and an annular piston, wherein said annular piston moves through said annular cylinder space, and wherein said annular cylinder space surrounds said bellows.

9. The apparatus of claim 1, further comprising a rotary filling machine, wherein said filling element is mounted on said rotary filling machine together with a plurality of additional filling elements, each of which has the same structure as said filling element.

10. The apparatus of claim 1, wherein said bellows comprises an inner space, wherein said inner space is configured to be pressurized with said operating medium, wherein said inner space is configured to connect with a gas path configured inside said filling element.

11. The apparatus of claim 1, wherein said bellows comprises an inner space, wherein said inner space is configured to be pressurized with said operating medium, wherein said inner space is configured to be part of a gas path configured inside said filling element.

* * * * *